United States Patent [19]

Kvalheim

[11] Patent Number: 5,054,857

[45] Date of Patent: Oct. 8, 1991

[54] CONVERTIBLE CHAIR

[76] Inventor: Andrew M. Kvalheim, 825 Petaluma Blvd. S., Petaluma, Calif. 94953

[21] Appl. No.: 572,692

[22] Filed: Aug. 27, 1990

[51] Int. Cl.[5] ..... A47C 7/50

[52] U.S. Cl. ..... 297/423; 297/429; 297/118

[58] Field of Search ..... 297/423, 118, 429, 19

[56] References Cited

U.S. PATENT DOCUMENTS 4,614,378 9/1986 Picou ..... 297/423 X
4,736,982 4/1988 Hwang ..... 297/423 X
4,793,655 12/1988 Kualheim et al. ..... 257/423

FOREIGN PATENT DOCUMENTS

W000275 1/1985 World Int. Prop. O. ..... 297/423

*Primary Examiner*—Peter A. Aschenbrenner
*Attorney, Agent, or Firm*—Alfons Puishes

[57] ABSTRACT

A chair constructed for alternate use as a conventional seat and back rest is adapted for ready conversion of its back rest to a knee rest. Novel converting means provide for independent conversion, movement, and fine adjustment of the seat and back-knee rests for greater flexibility and maximum comfort.

6 Claims, 11 Drawing Sheets

CONVERTIBLE CHAIR

FIELD OF THE INVENTION

This invention relates to chairs used for comfort and relief for persons by providing a knee rest to support the knees of a person while in a "sit-kneel" position on the chair. More specifically, it relates to chairs that may be readily converted from a conventional sitting position to a "knee rest" position by converting the back rest to a knee rest and adjusting the seat rest accordingly.

BACKGROUND OF THE INVENTION AND PRIOR ART

While chairs to provide for sitting in a "knee rest" position are quite old, the idea of a chair for conversion from conventional to a knee rest chair is more recent.

The closest art known to applicant is set forth below.

U.S. Pat. No. 4,736,982 to Hwang teaches a chair which is convertible by changing the relative position of a seat and back rest cushions. A combining of conversion and adjustment of seat and back rest position is not disclosed nor is a fine and independent adjustment of same.

U.S. Pat. No. 4,765,684 to Kvalheim and Pedersen teaches a chair which is convertible by use of a novel operating and interlocking mechanism for the seat. This also lacks the adjusting features mentioned above.

None of the prior art discloses independent and fine relative adjustment of the seat and back rest while converting from conventional to knee rest position.

SUMMARY OF THE INVENTION

I have invented a chair which is a definite improvement over previous chairs constructed to be converted from use in a normal seating position to use in a knee rest position by changing the back rest into a knee rest.

This I do first, as in previous chairs, by mounting the back rest on a pivoted arm and providing for swivelling the arm to put the back rest into a knee rest position. In my present invention however, I provide separate and independent moving and adjustment for the seat and back rest positions and provide a novel mechanism for adjusting the angle of the seat at a desired angle and maintaining it there. I then provide a separate and novel mechanism for converting the back rest to a knee rest and adjusting the position and maintaining it in the desired new position.

My chair is thus made convertible by independent adjustment of seat and back-knee rest cushions while providing for a fine and highly flexible adjustment.

I utilize two different embodiments of my back-knee rest cushions mechanism. In the first, which I designate as chair 1 herein, I utilize an adjusting knob operating through springs and friction discs which serve to rotate my pivoted arm carrying the back-knee rest and maintain it at any desired angle or position in the same operation.

In an alternate embodiment designated as chair 2 I use a commercially available air cylinder mechanism in combination with a novel mechanism to achieve the same results.

In both embodiments I utilize a similar air cylinder and a novel mechanism to finely adjust the seat in any desirable angle in relation to the back-knee rest, but independent of it.

The changing of position and adjustment of the seat, back and knee rest made independently of each other, is a big distinction of my invention from the prior art and provides for maximum comfort not previously attainable.

In addition I provide a separate angle adjustment for the back rest while it is so used, as well as a height adjustment for the seat.

I thus provide a chair of extremely great flexibility, adaptability, comfort, and convenience which is not obtained by previous chairs and represents a tremendous improvement over the prior art.

I provide also a safety device to prevent accidental or undesired movement of the back rest to a knee rest position.

DESCRIPTION OF A PREFERRED EMBODIMENT

Figure 1:
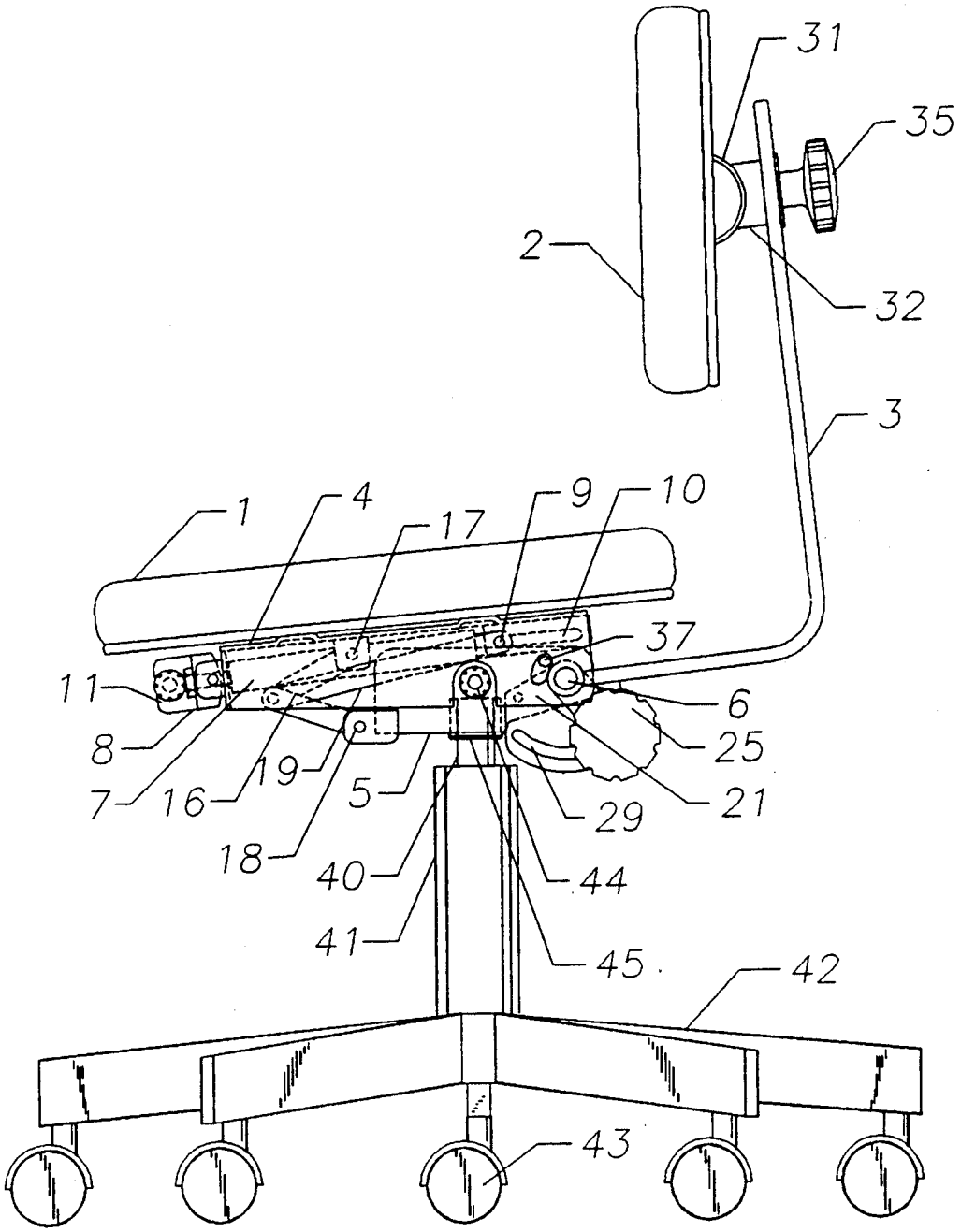
FIG. 1. Chair No. 1 in side elevation with chair in conventional position.
Figure 2:
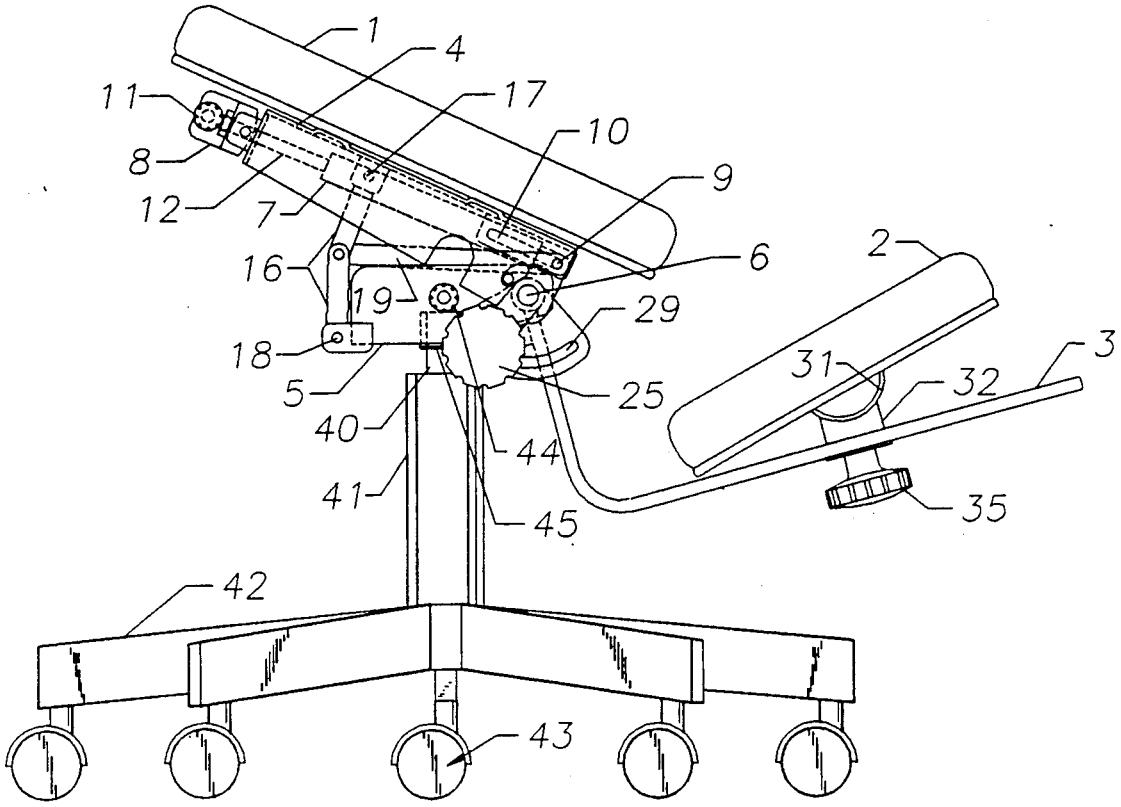
FIG. 2. Chair No. 1 in side elevation but with chair converted to knee rest position.
Figure 3:
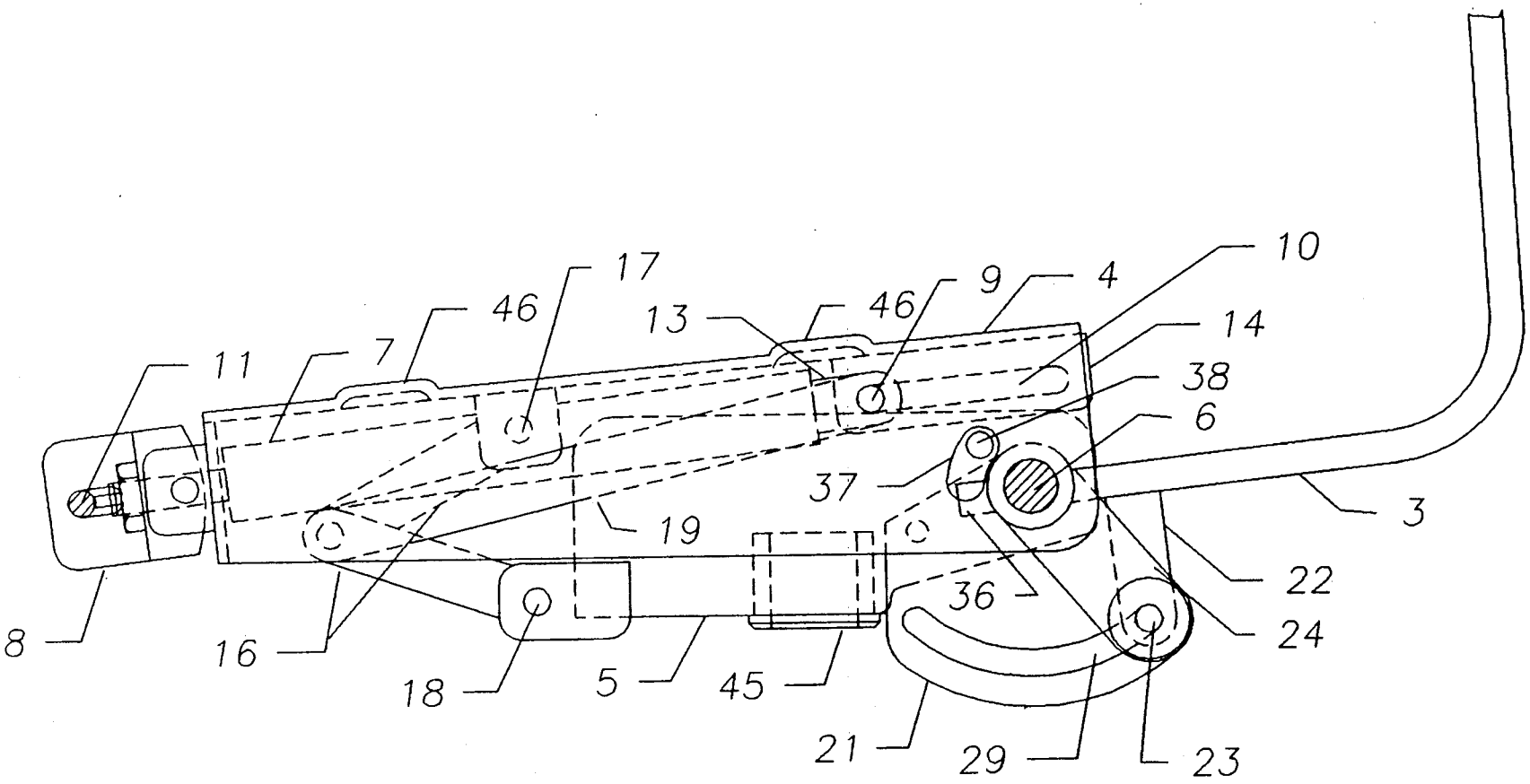
FIG. 3 The operating mechanism in side elevation of the chair of FIG. 1 in conventional position.
Figure 4:
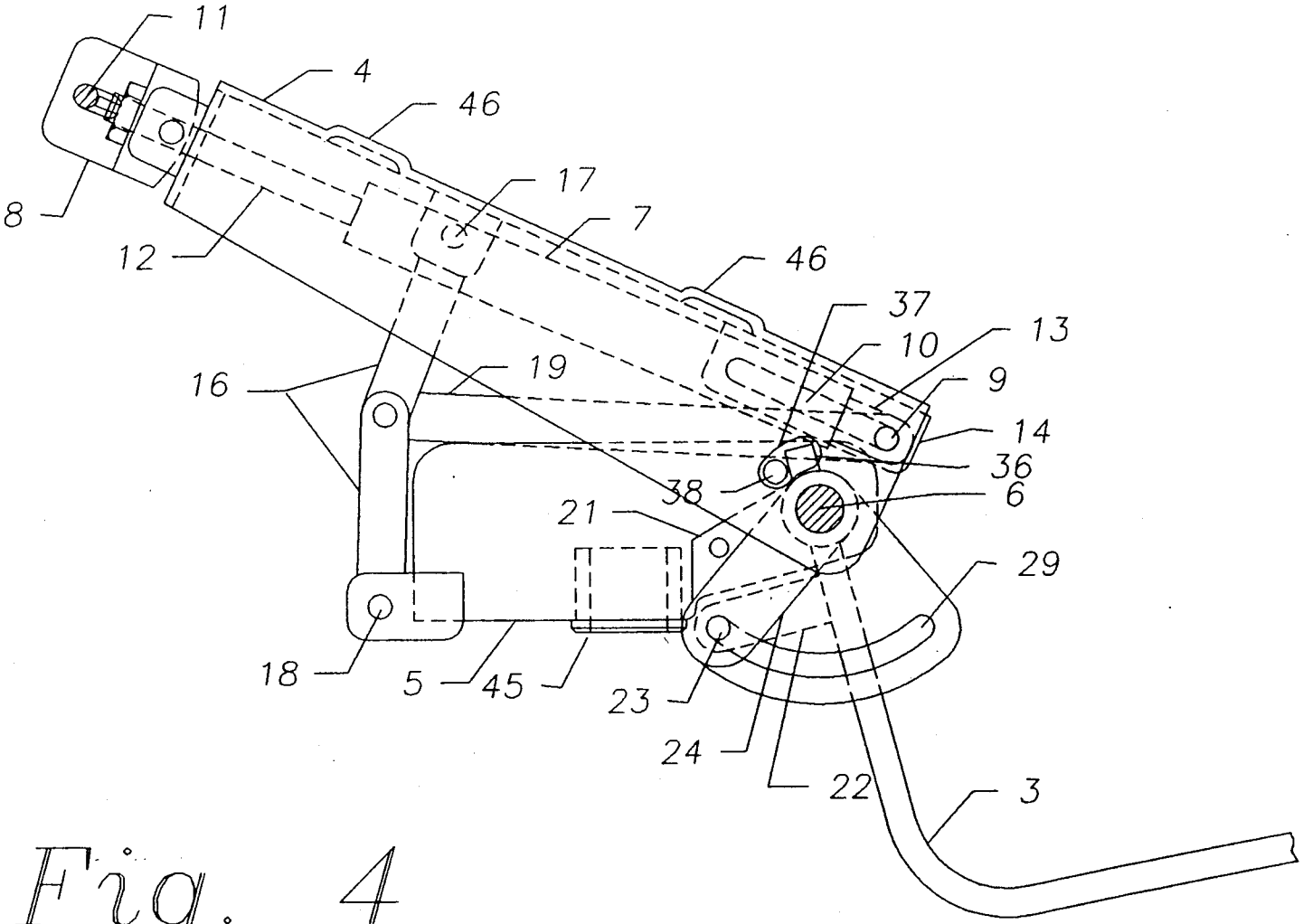
FIG. 4. The operating mechanism of chair No. 1 in side elevation with chair in knee rest position.

Referring first to FIG. 1 through FIG. 5, there is shown the seat rest 1 and back rest 2, the latter supported by arm 3 which is pivoted on pin 6. Seat 1 is supported by an upper support housing 4 while arm 3 is supported by lower support housing 5. The main operating force is supplied by operating cylinder 7 which is a gas spring mechanism commercially available and similar to that supplied by Gas Spring Company of Colmar, Pa. It is engaged by an upper support assembly 8, a sliding pin 9 which engages pin slot 10 and rides in support locks 14 positioned on upper support housing 4. Operation of cylinder 7 is actuated by handle 11 which engages piston rod extension 12 of cylinder 7. Lug 13, which forms a part of cylinder 7, serves to connect pin 9 to slot 10.

A link mechanism which is of a toggle type comprises link members 16 pivoted on pivot pin 17 on housing 4 and pivot pin 18 on housing 5. Link member 19 connects toggle links 16 with pin 9. It is thus evident, particularly from reference to FIG. 3 and FIG. 4 how movement of cylinder 7 effects the rotating of housing 4 about pin 6. Arm support member 22 which is disposed to rotate also about pin 6, at one end is disposed to carry shaft 23 on its opposite end. Support shaft 23 is disposed to ride in arcuate slot 29 as described more fully below. Member 21 supports pin 6 in housing 5.

Figure 5:
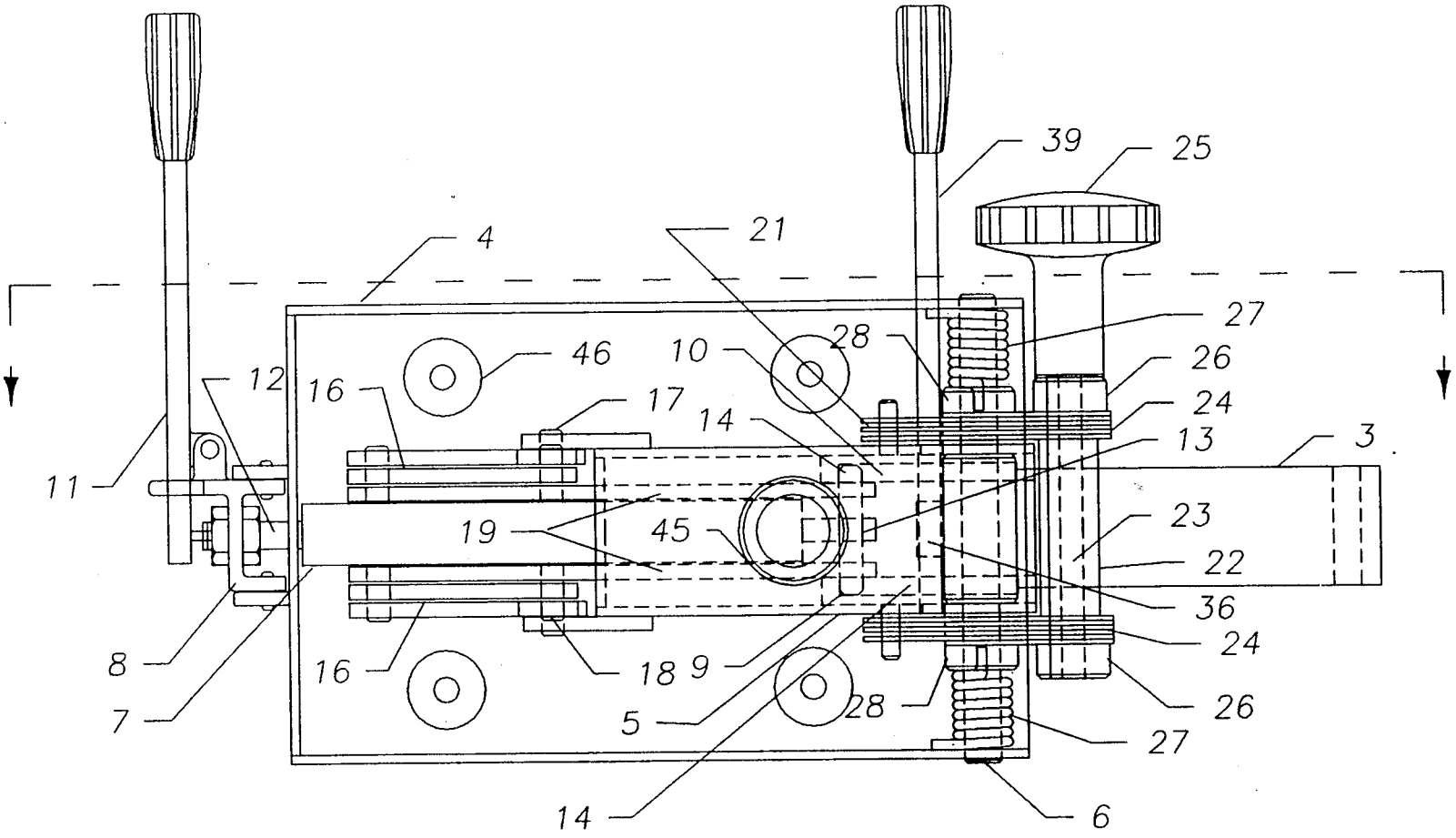
FIG. 5 The bottom view of the chair mechanism of chair No. 1 in conventional position.
Figure 6:
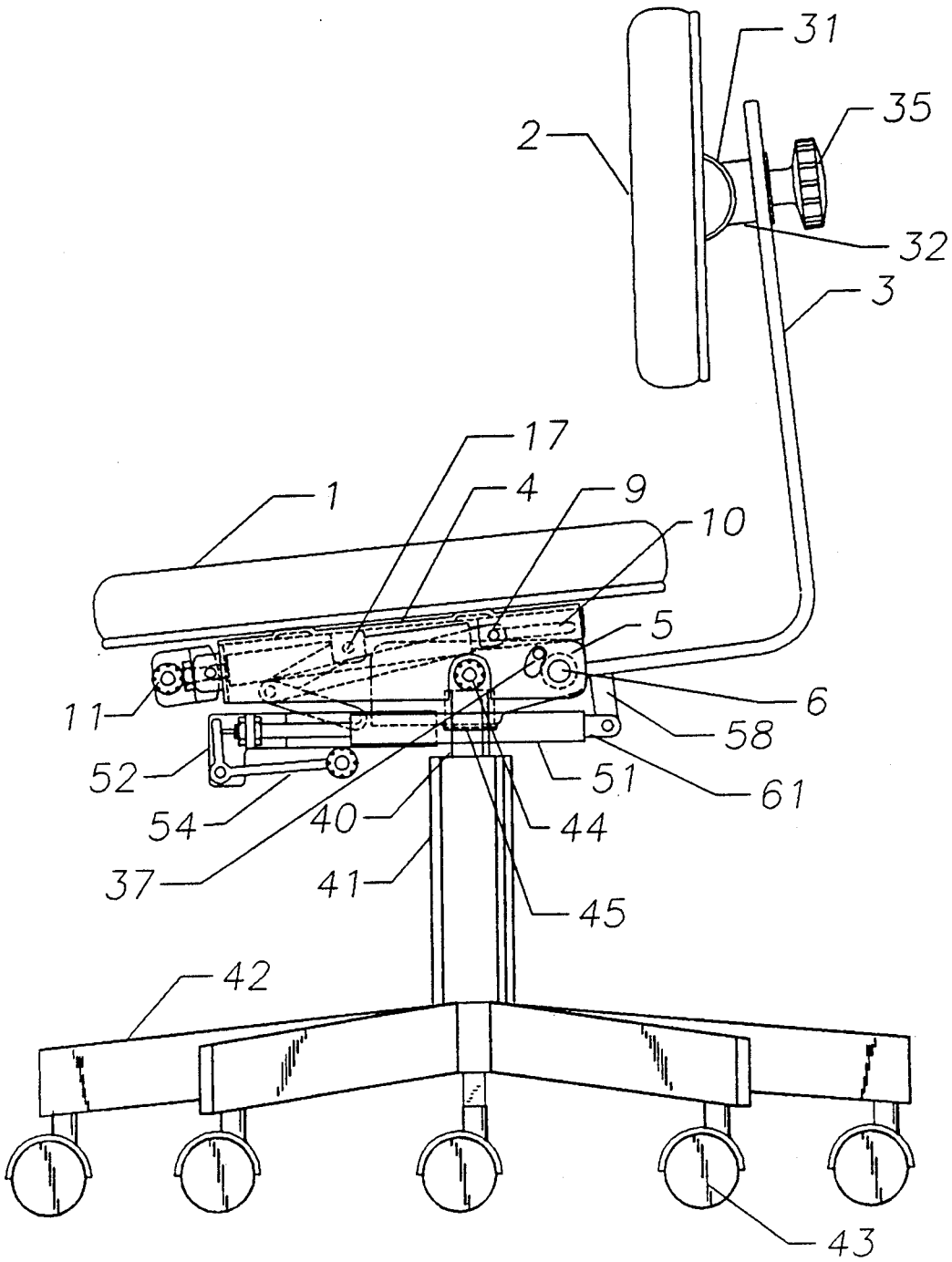
FIG. 6. Chair No. 2 in side elevation with chair in conventional position.
Figure 7:
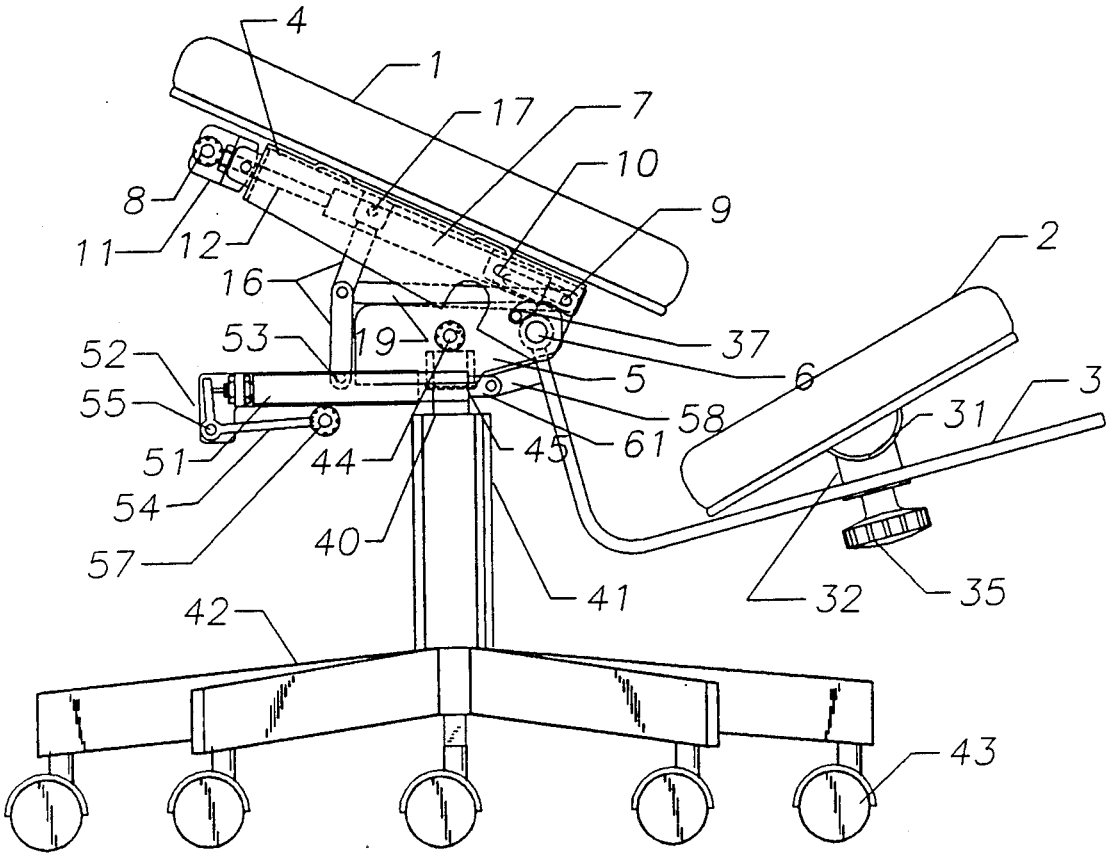
FIG. 7. Chair No. 2 in side elevation with chair in knee rest position.
Figure 8:
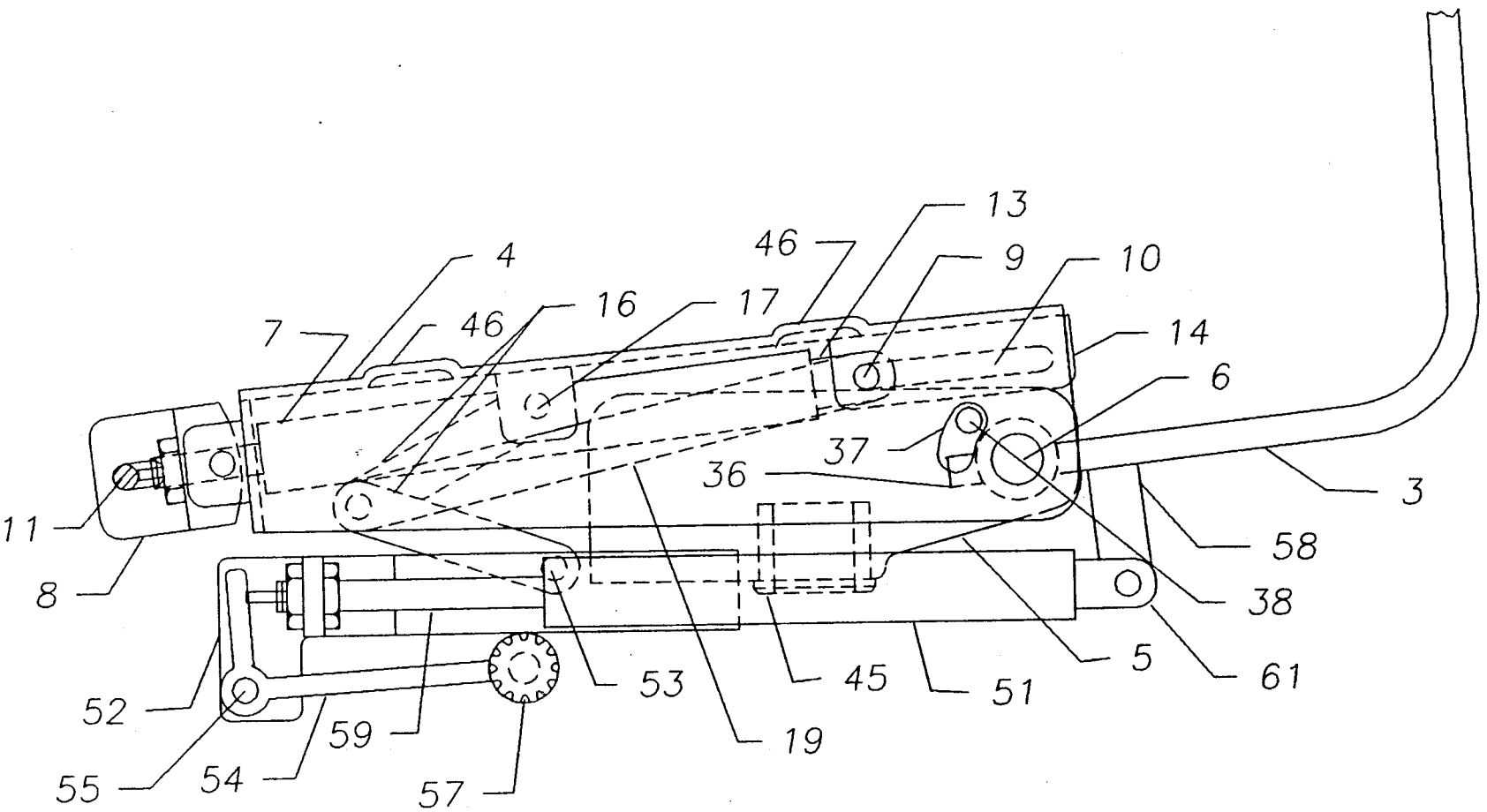
FIG. 8. Operating mechanism of chair No. 2, side elevation with chair in conventional position.
Figure 9:
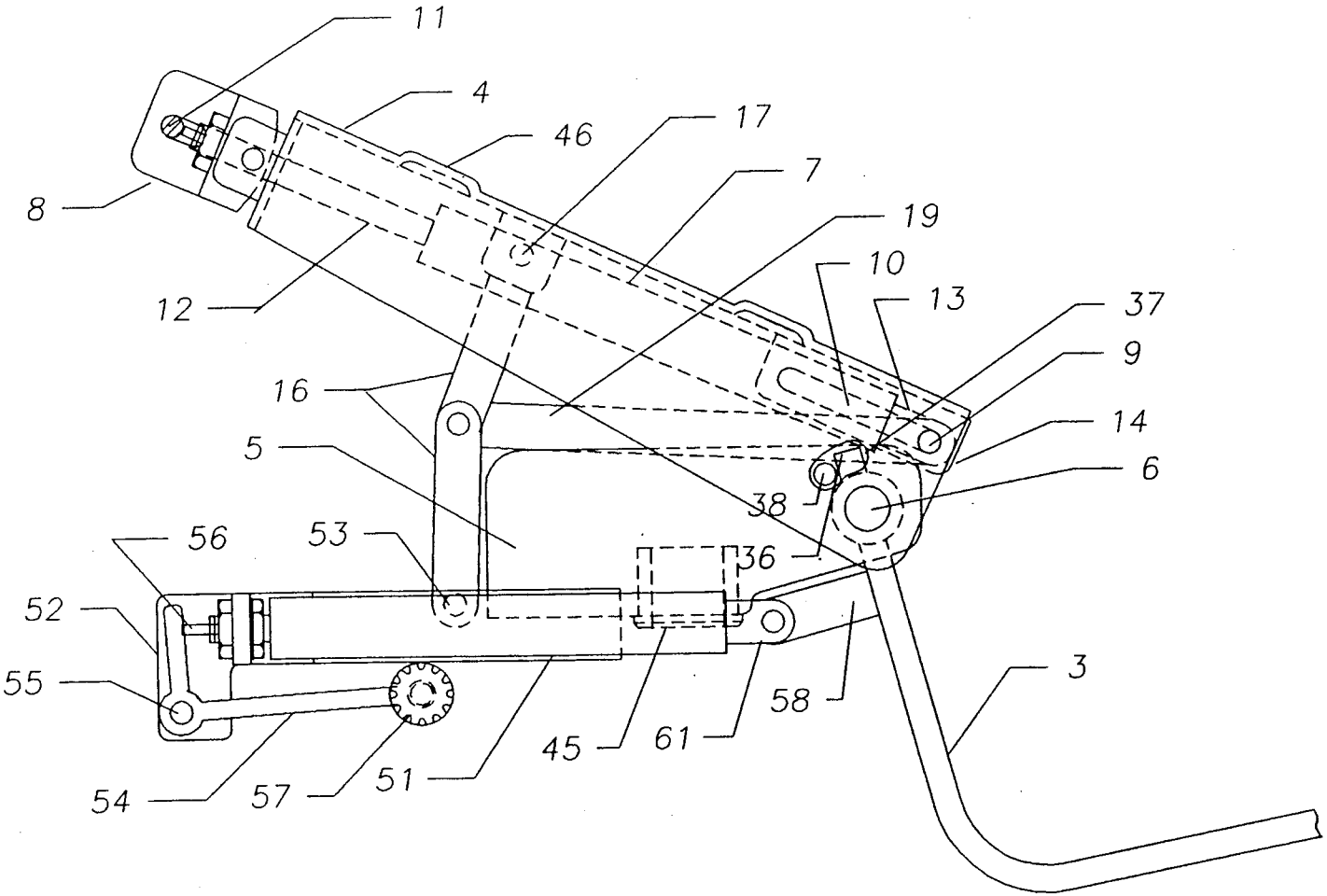
FIG. 9. Operating mechanism of chair No. 2 in side elevation, chair in knee rest position.

Referring now more particularly to FIG. 5, there is seen a plurality of friction plates or discs 24 engaged by shaft 23 and threaded knob 25 through collars 26. These in turn are engaged by helical or torsion springs 27 through collars 28 on pin 6 to support housing 5. It is thus evident how I rotate my arm 3 from a vertical or back rest position to a lower or knee rest position and may adjust and maintain it in any desired position relative to seat rest 1. From the foregoing it is also evident how I may adjust and maintain the angle of seat 1 at any angle relative to back or knee rest 2, each independently of the positioning operation of these seats and rests.

Referring back to FIG. 1 and FIG. 2 to show the structural support of the foregoing chair components, there is first seen piston 40 which may be of the gas spring type described previously in connection with cylinder 7. Piston 40 operates in central column 41 which in turn is supported by conventional type of legs 42 and casters 43. Adjusting arm 44 is used to operate piston 40 and collar 45 serves to connect the entire chair elements described above to piston 40. Seat fastening lugs 48, best seen on FIGS. 3 and 4, facilitate the positioning of seat 2 on upper housing 4.

ALTERNATE EMBODIMENT

Referring now to FIG. 6 through FIG. 10, there is seen an alternate embodiment for my chair.

Here the support housing and control mechanism for seat rest 1 are the same as previously described for my preferred embodiment and like numbers on these figures represent like elements of this part of my alternate embodiment.

In this embodiment instead of using the knob and friction discs for my support arm 3, I utilize a gas spring cylinder such as that previously described for my seat 1. Here said cylinders 51 are supported by brackets 52 upon lower housing 5 and engage pin 53 of the above described toggle linkage 16. A bell-crank type of device 54 operates on pin 55 positioned on bracket 60 and engages 56 which is a projection of the piston 59 of cylinders 51, previously described. A handle or arm 57 serves to operate these cylinders.

Figure 10:
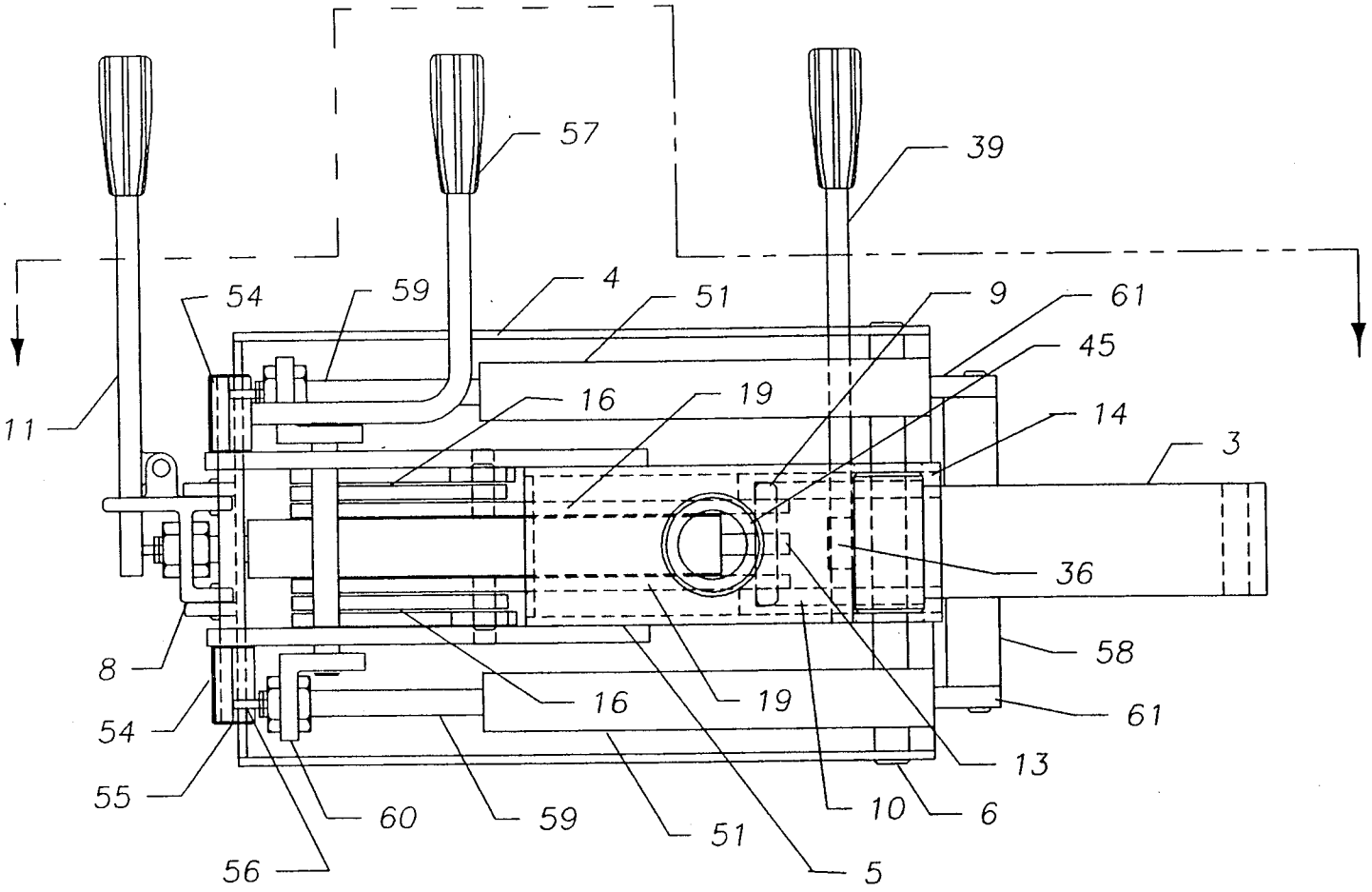
FIG. 10. Bottom view of operating mechanism of Chair No. 2 in conventional position.

Referring now to FIG. 10, it is seen that I employ in this embodiment, the cylinders in pairs 51 which are joined by bracket 58 connecting piston rods 59 which are in turn mounted on lower housing 5 at 60 and connected with lugs 61.

It is thus evident how I may adjust the position of my back rest arm 3 at any desired position independent of the adjustments of seat 1 and maintain it in the said position to serve as a back rest or a knee rest as desired in an alternate manner.

ADDITIONAL ELEMENTS—BOTH EMBODIMENTS

Figure 11:
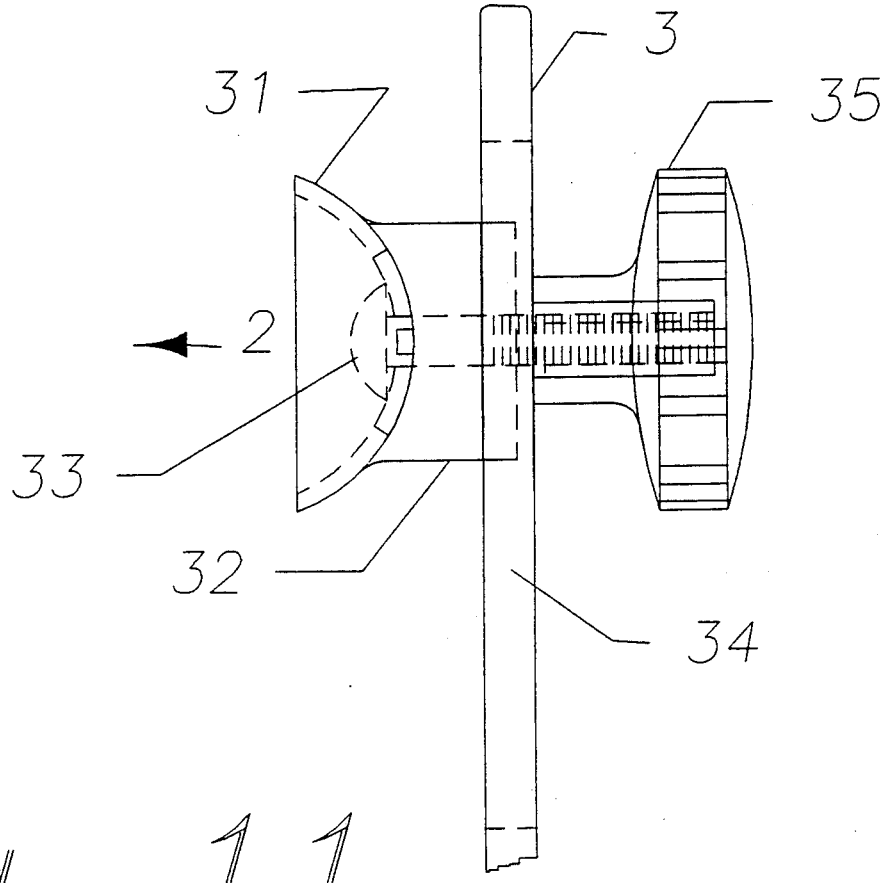
FIG. 11. Chairs No. 1 or 2, side view of mechanism for linear and angle adjustment of back rest.

Referring now to FIG. 11, there is seen an additional adjustment for back rest 2 which appears on FIGS. 1, 2, 6, and 7. Arcuate segment 31 is attached to the back of back rest 2 and rides on block 32 carried by arm 3. A carriage bolt type of fastener 33 holds the assembly in position through the action of adjusting knob 35. Block 32 rides in slot 34 in arm 3 to permit vertical adjustment of back rest 2. Angular adjustment is obtained through the action of arcuate segment 31.

The angular pivoting of arm 3 and position of back rest 2 is further controlled and limited by a limiting and safety device seen on FIGS. 1 through 10. This comprises a pad or extension 36 which forms a part of arm 3 and engages arcuate guide 37 in lower support housing 5. A pinhole 38 through support housing 5 is positioned to permit insertion of a pin 39 to impede the motion of pad 36 along guide 37. When inserted the pin 39 limits the travel of arm 3 through an angle of approximately 15° when 2 is acting as a back rest and prevents arm 3 from accidentally falling back to a knee rest position which it cannot do unless pin 39 is removed.

I claim:

1. A chair adapted for supporting a person alternately in a conventional sitting position and in a knee rest position and having a basic supporting structure comprising:

a first cushion mounted on a first support housing and being disposed to support the posterior of a person;

said first support housing being pivotally mounted on a second support housing;

a second cushion pivotally mounted on an arm on said second support housing and being initially disposed to support the back of a person, said first and said second support housings being mounted on said basic supporting structure;

means for simultaneously tilting and adjusting the position of said first support housing and said first cushion in a vertical plane to a second predetermined position comprising:

an actuating piston and movable cylinder mounted on said first housing;

a linkage mechanism engaging said cylinder;

a first end of said linkage mechanism pivotally connected to said cylinder;

a second end of said linkage mechanism pivotally engaging said second housing;

means for actuating said piston and said cylinder;

whereby said first support housing and said first cushion are adjustably tilted to said second predetermined position;

means for combined pivoting and adjusting the position of said arm and said second cushion in a vertical plane to a second predetermined position relative to said second position of said first cushion;

whereby said second position of said second cushion is disposed to support the knees of a person while seated on said first cushion in the said second position of said first cushion.

2. The chair of claim 1 in which said means for simultaneously pivoting and adjusting the position of said arm and said second cushion to a second predetermined position comprises:

a first shaft positioned on said second housing;

a plurality of friction discs positioned on said first shaft;

spring means engaging said friction discs and said second housing;

a second shaft arcuately mounted on said housing and engaging said friction discs on said arm;

an adjusting knob mounted on said second shaft and engaging said friction discs.

3. The chair of claim 1 or claim 2 including an adjustable backrest support arm comprising:

a spherical segment positioned on the back of said back rest;

a movable block engaging said segment and said arm;

a longitudinal groove in said arm adapted to received said block;

a bush threadably engaging said arm and said block and said segment.

4. The chair of claim 1 or claim 2, or claim 3, including an adjustable back rest support arm comprising:

a spherical segment positioned on the back of said back rest;

a movable block engaging said segment and said arm;

a longitudinal groove in said arm adapted to receive said block;

a knob threadably engaging said arm and said block and said segment.

5. The chair of claim 1 or claim 2, or claim 3, or claim 4, including means for adjusting the vertical height of said first cushion.

6. The chair of claim 1, or claim 2, or claim 3, or claim 4 including limiting means disposed for, engaging said arm to limit its movement through an angle of approximately 15° in a vertical plane when supporting the back of a person and being further disposed to permit movement of said arm to said second predetermined position when desired.

* * * * *